United States Patent [19]

Morris et al.

[11] Patent Number: 4,480,163

[45] Date of Patent: Oct. 30, 1984

[54] VANDAL-RESISTANT PUSH BUTTON ELECTRICAL SWITCH ASSEMBLY

[75] Inventors: Earl L. Morris, La Habra Heights; Walter V. Hafner, Whittier; Ron T. Hahn, Fullerton, all of Calif.

[73] Assignee: Acorn Engineering Company, City of Industry, Calif.

[21] Appl. No.: 455,753

[22] Filed: Jan. 5, 1983

[51] Int. Cl.[3] ..... H01H 13/00

[52] U.S. Cl. ..... 200/331; 200/153 T; 200/340

[58] Field of Search ..... 200/330, 331, 340, 295, 200/296, 294, 297, 153 T, 159 R

[56] References Cited

U.S. PATENT DOCUMENTS

| | | | |
|---|---|---|---|
| 2,440,288 | 4/1948 | Paulus et al. | 200/296 X |
| 2,740,023 | 3/1956 | Kryder | 200/330 |
| 2,984,726 | 5/1961 | Roeser | 200/330 |
| 3,121,777 | 2/1964 | Gallas | 200/330 |
| 3,239,641 | 3/1966 | Pettit | 200/330 |
| 3,293,380 | 12/1966 | Davis | 200/340 X |
| 4,043,115 | 8/1977 | Bryceland | 200/159 R X |
| 4,053,726 | 10/1977 | Schaad | 200/159 R |
| 4,297,556 | 10/1981 | Taylor | 200/330 |

FOREIGN PATENT DOCUMENTS

| | | | |
|---|---|---|---|
| 2023937 | 1/1980 | United Kingdom | 200/340 |

*Primary Examiner*—Stephen Marcus
*Assistant Examiner*—Ernest G. Cusick
*Attorney, Agent, or Firm*—Edgar W. Averill, Jr.

[57] ABSTRACT

A vandal-resistant push button switch assembly. The switch assembly has a switch actuating device with no exposed fasteners which switch may be used in a prison cell or other area requiring a high degree of vandal resistance. Although the switch may be readily operated from within the cell, it cannot be removed from the cell or destroyed under anything but the most extreme conditions. The switch has a push button actuating shaft which is depressed by the user and this shaft in turn activates a push button electrical switch mounted on the back side of the mounting surface.

7 Claims, 6 Drawing Figures

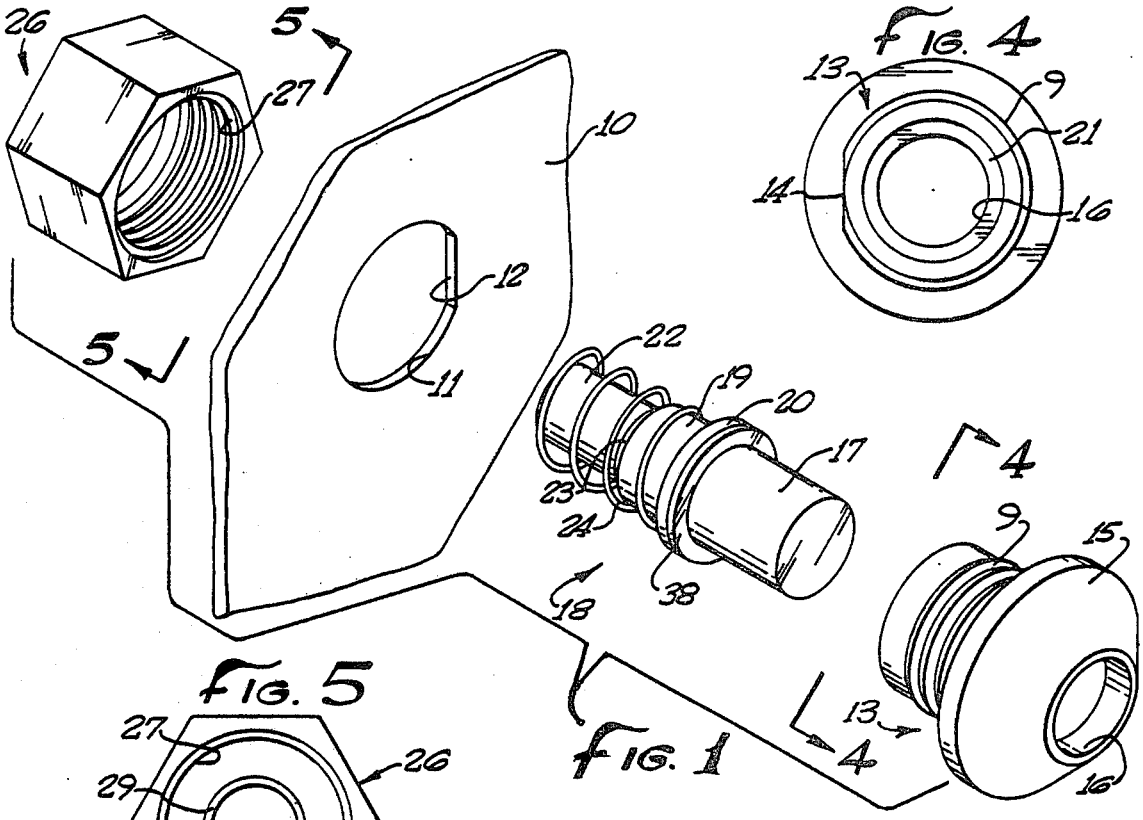
FIG. 1
FIG. 4
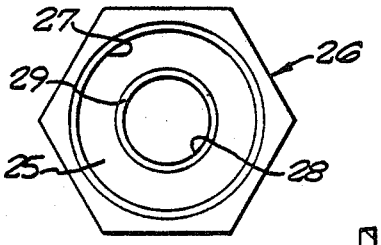
FIG. 5
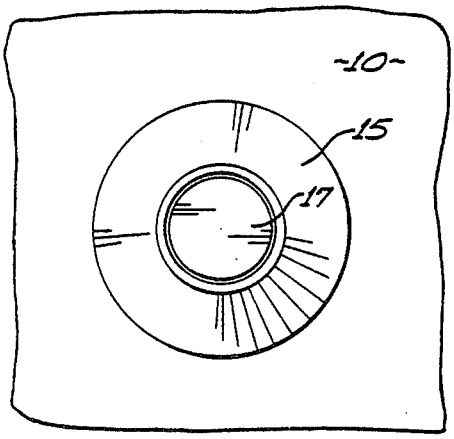
FIG. 3
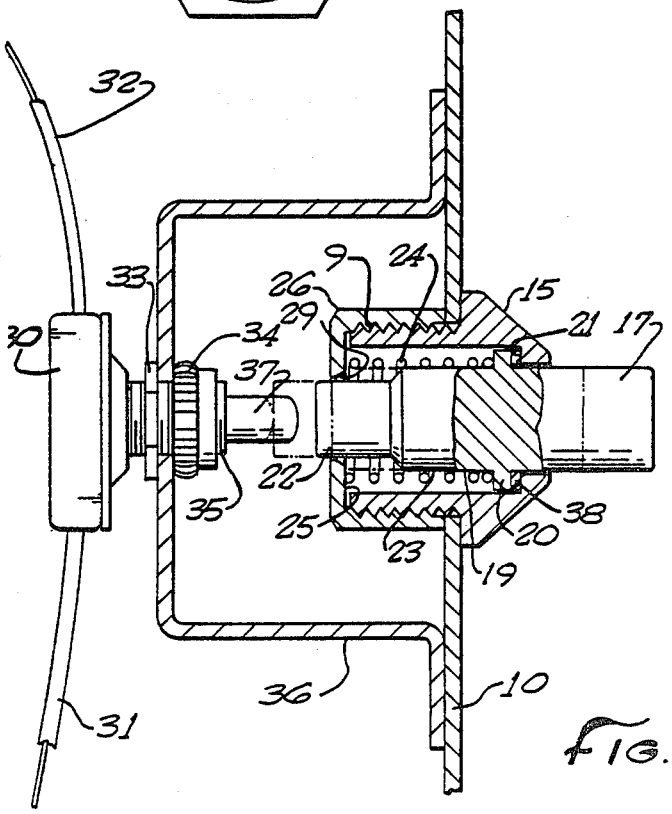
FIG. 2

VANDAL-RESISTANT PUSH BUTTON ELECTRICAL SWITCH ASSEMBLY

CROSS REFERENCE TO RELATED APPLICATIONS

This application is being filed the same day as the following applications which are assigned to the assignee of the present application: Ser. No. 455,746, filed Jan. 5, 1983, Wall Sleeve and Installation Jig for Multiple Adjacent Fixture Mounting; Ser. No. 455,752, filed Jan. 5, 1983 Vandal Resistant and Tamper-Proof Plenum or Vacuum Chamber Security Air Flow Adjustment Device; Ser. No. 455,751, filed Jan. 5, 1983 Plenum/Vaccum Chamber with Duct Connection for Installation in Cabinet Fixtures to Control Air Supply or Return; Ser. No. 455,750, filed Jan. 5, 1983, Vandal Resistant Light Fixture; Ser. No. 455,668, filed Jan. 5, 1983 Security Mirror Replaceable from Pipe Chase and Ser. No. 455,655, filed Jan. 5, 1983 Vandal Resistant and Tamper-Proof Multi-Purpose Modular Lavatory/Toilet.

BACKGROUND OF THE DISCLOSURE

The field of the invention is switches for use in applications where vandal resistance is desirable. The invention relates more particularly to electrical switch activating devices operable from within a room or cell with no exposed fasteners in the cell which switch may be replaced and serviced from the back side of the plate upon which it is mounted or from the chase area.

The widely used types of electrical switches are not useful in an application such as a prison cell. It is necessary that there be no reasonable possibility that the switch could be disassembled and provide a means for either self-destruction of the prisoner or injury to others. Thus, the widely used residential, commercial or industrial switches are inappropriate since they may typically be disassembled from the front surface thereof.

It is important, however, that the switch be serviceable and it is highly desirable that it be serviceable from outside of the room in which it is installed. Most prior art electrical switches are serviced from within the room in which they are installed. This has several disadvantages in the instance of a prison cell. The steps required to provide maintenance service in a prison cell are labor intensive.

First, it must be understood that prison guards or security personnel are not permitted to do service or maintenance work. Furthermore, maintenance personnel are not trained or equipped to guard prisoners. Still further, tools which are required to perform maintenance are potentially capable of being used as weapons and it thus becomes necessary for the maintenance personnel to be kept separated from the prisoners. Therefore, even for a simple maintenance task to be performed in the cell it is necessary to first remove the prisoner or prisoners from the cell. Secondly, the maintenance man, accompanied by a security man enter the cell. A second security man may also be required to escort the maintenance man to the cell door. It can thus be seen that a task as ostensibly simple as changing a light bulb becomes a disruptive and labor intensive task if it must be done from within the cell. These steps are eliminated when service can be performed from the pipe chase where an unescorted service man may do the work. Secondly, the ability to service from within the cell necessitates an increased possibility that the switch may be dismantled from within the cell and thus create the possibility of a dangerous condition.

It is thus an object of the present invention to provide a vandal-resistant electrical switch which can be serviced from outside of the room in which it is installed and which does not provide any likelihood of providing a source of electrical shock to the user.

SUMMARY OF THE INVENTION

The present invention is for a vandal-resistant push button switch assembly its sleeve extending through the mounting plate and its escutcheon end abutting the interior surface of the plate. A push button and actuating shaft assembly has a push button end extending interiorly beyond the escutcheon end and an actuating shaft extending in the opposite direction which shaft is extendable beyond the sleeve when the push button is depressed. The push button and actuating shaft assembly is held within the sleeve and escutcheon member and has spring stop means located between the ends thereof. Spring means surround the interior of the actuating end of the push button and actuating shaft assembly and the spring means abut the spring stop means at one end. Nut means are threadably engaged to the exterior of the sleeve and hold the escutcheon against the mounting plate and are tightened against the back surface of the mounting plate. The nut means also has spring stop means located therein and the nut means further has an opening through which the actuating shaft extends. Switch means are held axially with respect to the push button and actuating shaft assembly and are positioned so that the switch portion thereof is activated by contact with the actuating shaft when the push button is depressed. Preferably, the push button portion is a stepped cylinder and the sleeve is keyed into the mounting plate so that sleeve and escutcheon assembly cannot be turned from the operating end of the assembly.

BRIEF DESCRIPTION OF THE DRAWINGS

FIG. 1 is an exploded perspective view of the push button assembly of the present invention.

FIG. 2 is a side view, partly in cross section of the push button assembly and switch of the present invention.

FIG. 3 is a front view of the push button assembly of the present invention.

FIG. 4 is a view taken along line 4—4 of FIG. 1.

FIG. 5 is a view taken along line 5—5 of FIG. 4.

DESCRIPTION OF THE PREFERRED EMBODIMENTS

Figure 6:
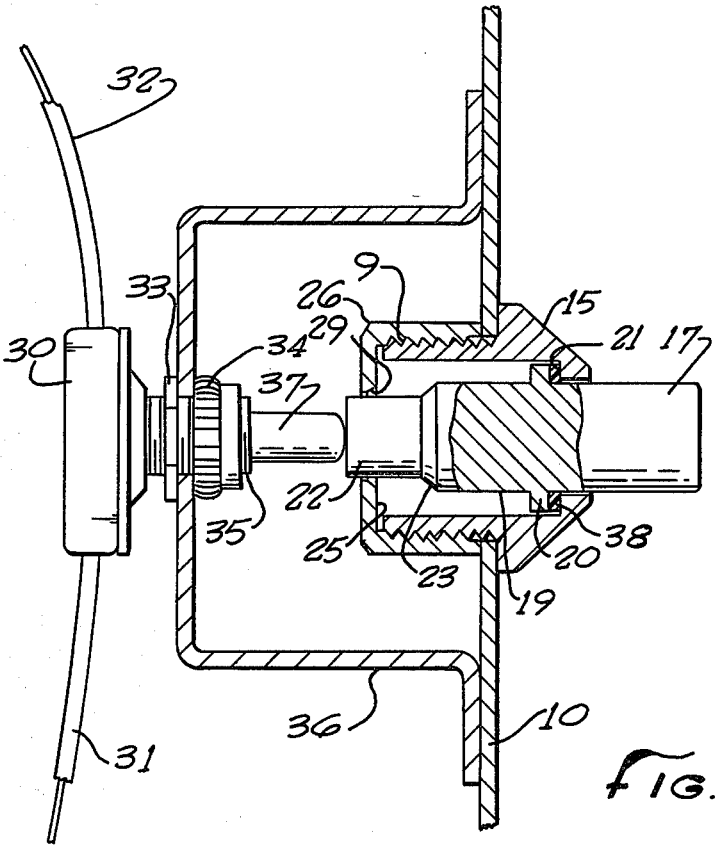
FIG. 6 is a side view, partly in cross section of an alternate embodiment of the switch of FIG. 1.

The switch assembly of the present invention is mounted on a mounting plate 10 which may form a portion of a lighting fixture mounted in a prison cell, mental institution or other area requiring a high degree of vandal resistance. Typically, mounting plate 10 will be formed from stainless steel, steel or other sturdy material of construction. Mounting plate 10 has an opening 11 punched therethrough. Opening 11 has a flattened portion 12.

A sleeve and escutcheon member 13 fits in opening 11 in such a manner that the flat portion 14 (shown in FIG. 4) of escutcheon 15 fits against the flattened portion 12 of opening 11 preventing the turning of member 13 with respect to mounting plate 10. Member 13 has an escutcheon 15 which fits against the inner or operating surface of mounting plate 10 in a manner shown both in FIGS. 2 and 3. Escutcheon 15 has a central axial opening 16 through which push button 17 extends. Push button 17 forms a portion of the push button and actuating shaft assembly indicated generally by reference character 18. Assembly 18 is shown as a stepped cylindrical shaft member having a first cylindrical size indicated by push button 17 and by shaft 19 and an enlarged ring 20 which serves as a stop or seat both for the spring and to limit the outward movement of the push button as shown best in FIG. 2. Ring 20 rests against annular surface 21 of the sleeve and escutcheon member shown best in FIG. 4. Push button and actuating shaft assembly 18 has a third diameter at actuating shaft 22, and a frustroconical portion 23 limits the inward motion of the push button and actuating shaft assembly as described more fully below. A spring 24 has one end against ring 20 and its other end against the surface of the annular base 25 of the nut 26. Nut 26 is provided with interior threads 27 which mate with the exterior threads on sleeve 9. An opening 28 is located in the center of the base 25 and actuating shaft 22 passes through opening 28 as shown in FIG. 2.

The switch assembly is shown in FIG. 2 and it can be seen that nut 26 holds the escutcheon 15 against mounting plate 10 and because of the flattened portion 12 in opening 11 and the flattened portion 14 on the sleeve 15, the escutcheon cannot be turned from the operating side of the switch and thus forms a highly vandal-resistant installation. Also, in FIG. 2 it can be seen that opening 28 has a small frustroconical ring 29 which touches the frustroconical portion 23 when the switch is fully depressed.

An electrical switch is indicated generally by reference character 30 and comprises a conventional push button switch having conductors 31 and 32. Switch 30 is held onto mounting bracket 36 by nuts 33 and 34 which are threaded onto threaded shaft 35. Bracket 36 may be welded or otherwise affixed to mounting plate 10, but this means for affixing should be such that there are no exposed fasteners on the operating surface of mounting plate 10. The switch is shown in phantom view in its depressed configuration in FIG. 2 and it can be seen that the downward movement of actuating shaft 22 is limited by the contact of the frustroconical portion 23 with the frustroconical recess 29. By the apppropriate mounting of electrical switch 30, which is longitudinally adjustable by turning nuts 33 and 34, it would be impossible to damage switch 30 by pushing too hard on its push button 37.

An alternate embodiment of the switch of FIG. 1 is shown in FIG. 6. The biasing to return the push button 17 is provided by the switch 30 and it can be seen that spring 24 may be eliminated. Preferably shaft 22 touches push button 37 so that ring 20 is held against nylon washer 38 to prevent rattling.

As can be seen in FIG. 3, the switch actuating assembly presents a simple button and escutcheon view from the interior or cell and provides no reasonable opportunity for damage to the switch or hazard of electrical shock to the occupant of the room or cell.

While a flattened portion is shown as the means of keying the sleeve and escutcheon member into a nonrotating fit in mounting plate 10, there are other methods for accomplishing this desired end. For instance, a tab could be formed in opening 11 and a groove in sleeve 15.

A substantial advantage of the assembly of the present invention is its ability to be serviced from outside of the cell or room in which it is mounted. Typically, in modern prisons a fixture is provided the interior of which is accessible from a pipe chase or other passageway on the other side of the cell wall. Bracket 36 extends in the direction toward the pipe chase and is readily accessible from the pipe chase. In this way when the electrical switch fails, it can readily be removed without having to enter the cell merely by loosening nut 34 and removing switch 30 and replacing it with an operable switch.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A Vandal-resistant push button switch assembly comprising:

a mounting plate having a first surface which faces the direction from which the switch is operated and a second surface on the other side thereof;

a sleeve and escutcheon member having a sleeve end extending through an opening in the mounting plate said sleeve end having an outside diameter and an escutcheon end abutting the first surface of said plate and having an escutcheon held thereon;

a push button and actuating shaft assembly having a push button end extending away from the first surface beyond the escutcheon end and an actuating shaft extending away from the second surface and being extendable beyond the sleeve and escutcheon member, said push button and actuating shaft assembly being held within said sleeve and escutcheon member and having stop means located between the ends thereof;

holding means affixed to the exterior of the sleeve end of the sleeve and escutcheon member holding said escutcheon against the mounting plate, and said holding means further having an opening to permit contact of the actuating shaft with electrical switch means;

spring means surrounding the actuating shaft of the push button and actuating shaft assembly, said spring means abutting said stop means at one end and said holding means at the other end; and electrical switch means held axially with respect to the push button and actuating shaft assembly and positioned so that the switch means is activated by contact with the actuating shaft when the push button is depressed.

2. The switch assembly of claim 1 wherein said push button and actuating shaft assembly is a stepped cylinder having a first cylindrical portion comprising the push button end which extends away from the first surface past the escutcheon, a second enlarged portion comprising the stop means, a third intermediate portion having a smaller diameter than the stop means and a fourth cylindrical portion having a smaller diameter than the third intermediate portion.

3. The switch assembly of claim 2 wherein the holding means has an annular base having a circular opening slightly larger than the actuating shaft and smaller than the third intermediate portion whereby the movement of the actuating shaft in the direction toward the electrical switch means is limited in outward movement by the abutting of the third intermediate portion with the annular base of the holding means and an electrical switch mounted on a bracket affixed to the second surface of the mounting plate, said electrical switch being affixed with respect to the mounting plate and located so that the maximum depression of said assembly does not exceed the maximum appropriate depression of the electrical switch.

4. The switch assembly of claim 1 wherein said holding means is cupped shaped including a hollow interior closed by a base end and said base end having an opening in the center, said opening being slightly larger than the actuating shaft.

5. The switch assembly of claim 1 wherein said sleeve end of said sleeve and escutcheon member and said mounting plate have locking means to prevent the rotation of the sleeve with respect to the plate.

6. The switch assembly of claim 5 wherein said sleeve has a flattened portion on the exterior thereof and the opening in the mounting plate has a matching flat portion extending inwardly.

7. A vandal-resistant push button switch assembly comprising:

a mounting plate having a first surface which faces the direction from which the switch is operated and a second surface on the other side thereof;

a sleeve and escutcheon member having a sleeve end extending through an opening in the mounting plate said sleeve end having an outside diameter and an escutcheon end abutting the first surface of said plate and having an escutcheon held thereon;

a push button and actuating shaft assembly having a push button end extending away from the first surface beyond the escutcheon end and an actuating shaft extending away from the second surface and being extendable beyond the sleeve and escutcheon member, said push button and actuating shaft assembly being held within said sleeve and escutcheon member and having stop means located between the ends thereof and said push button and actuating shaft assembly being a stepped cylinder having a first cylindrical portion comprising the push button end which extends away from the first surface past the escutcheon, a second enlarged portion comprising the stop means, a third intermediate portion having a smaller diameter than the stop means and a fourth cylindrical portion having a smaller diameter than the third intermediate portion;

holding means affixed to the exterior of the sleeve end of the sleeve and escutcheon member holding said escutcheon against the mounting plate, and said holding means further having an opening to permit contact of the actuating shaft with electrical switch means, and electrical switch means held axially with respect to the push button and actuating shaft assembly and positioned so that the switch is activated by contact with the actuating shaft when the push button is depressed.

* * * * *